United States Patent [19]

Kranz

[11] 4,250,876

[45] Feb. 17, 1981

[54] EMERGENCY LIFE SUPPORT SYSTEM

[75] Inventor: Max L. Kranz, Brea, Calif.

[73] Assignee: Robertshaw Controls Company, Richmond, Va.

[21] Appl. No.: 932,535

[22] Filed: Aug. 10, 1978

[51] Int. Cl.[3] ..... A62B 9/02

[52] U.S. Cl. ..... 128/202.22; 128/204.18; 128/206.28

[58] Field of Search ..... 128/142.2, 202.22, 204.18, 128/204.26, 205.25, 206.21, 206.28, 207.12

[56] References Cited

U.S. PATENT DOCUMENTS

| | | | |
|---|---|---|---|
| 2,362,643 | 11/1944 | Lambertsen | 128/142.2 |
| 2,406,888 | 9/1946 | Meidenbauer | 128/142.2 |
| 2,523,906 | 9/1950 | Holmes | 128/142.2 X |
| 2,854,001 | 9/1958 | Humblet | 128/142.2 |
| 2,861,569 | 11/1958 | Emerson | 128/142.2 |
| 3,147,761 | 9/1964 | Lecocq | 128/142.2 |
| 4,127,129 | 11/1978 | Cramer | 128/142.2 |

FOREIGN PATENT DOCUMENTS

| | | | |
|---|---|---|---|
| 1104829 | 4/1961 | Fed. Rep. of Germany | 128/142.2 |

*Primary Examiner*—Harry N. Haroian

*Attorney, Agent, or Firm*—Fulwider, Patton, Rieber, Lee & Utecht

[57] ABSTRACT

There is disclosed an emergency breathing apparatus that provides a sustained life support for a period of time up to about 30 minutes and that is useful for fire fighters and the like in a hostile environment. The device comprises a harness with a backpack air supply cylinder provided with a shut-off valve and pressure regulator at the cylinder. The regulator has a bypass connection for attachment of a remote pressure sensor and a valve which opens when the pressure declines to a predetermined value and applies regulated air pressure to an audible warning device such as a whistle, buzzer, bell and the like. The device employs a pilot regulator on the mask which is a very compact and simple structure with only a few moving parts, and consequently, easier to manufacture and maintain than more bulky, complicated structures of the prior art. The pilot regulator is provided with a manual switch to change its operation from demand to pressure demand so that the mask can be donned in the demand position without a continuous loss of air and thereafter switched to the pressure demand mode to provide a continuous, regulated supply of air to the user.

4 Claims, 11 Drawing Figures

EMERGENCY LIFE SUPPORT SYSTEM

BACKGROUND OF THE INVENTION

1. The Field of Invention

This invention relates to an emergency breathing apparatus and, in particular, to an apparatus suitable for a sustained period of air supply useful for workers such as fire fighters in hostile areas.

2. Brief Statement of the Prior Art

Emergency breathing systems have evolved into a number of standardized versions. These include the devices for short periods of operation, e.g., about 5 minutes, and devices for sustained duration, typically 30 minutes. The latter have requirements such as remote pressure gauges to indicate to the user the pressure of the air supply bottle at all times, an audible alarm which is triggered when the air reservoir pressure falls below a predetermined value such as about 500 psig, and a demand face mask regulator which provides a flow of air to the user on demand. Typically, the air reservoir is a bottle at a high pressure, about 2000 psig and a pressure reducing valve is employed adjacent the face valve regulator to reduce the air pressure to about 80–100 psig. A flexible hose has been used to connect between the shut-off valve located at the air supply bottle and the pressure reducing valve. This flexible hose is a potentially hazardous structure since the hose can be ruptured or entangled during use of the device. In addition to this disadvantage, the prior systems have other drawbacks. The audible alarms used on prior devices have been operated by the air reservior pressure and have offered a compromise performance since the intensity of their alarm declines with the declining air reservior pressure. The mask regulator valves employed with the prior devices are relatively bulky and complex with a large number of moving parts which are prone to mechanical failure. Finally, the users commonly don the face mask with the air supply valve open and a significant amount of air is lost during the mask donning procedure.

BRIEF DESCRIPTION OF THE INVENTION

This invention comprises an emergency breathing apparatus which meets the applicable safety regulations for such emergency devices, including the requirements for a pressure demand regulator, a remote air reservoir pressure indicator, an audible air pressure alarm, etc. The apparatus, additionally, eliminates the potentially hazardous high pressure air hose by positioning the pressure reducer valve adjacent the shut-off valve at the discharge of the air supply bottle. The apparatus employs the regulated air supply to operate the audible alarm which is triggered by the decline of pressure in the air supply bottle to below the predetermined value, thus providing a sustained audible alarm. The apparatus of the invention also employs a pilot regulator for the face mask, a structure which is very compact and has only three moving parts. Additionally, the pilot regulator is provided with a manual switch to change its function between demand and pressure demand to permit the user to don the mask in the demand mode when air is supplied only upon the application of inhalation pressure to the pilot regulator, thereby preventing wasteful discharge of the limited air supply during the donning of the face mask.

BRIEF DESCRIPTION OF THE DRAWINGS

The invention will be described with reference to the figures of which.

DESCRIPTION OF PREFERRED EMBODIMENTS

Figure 1:
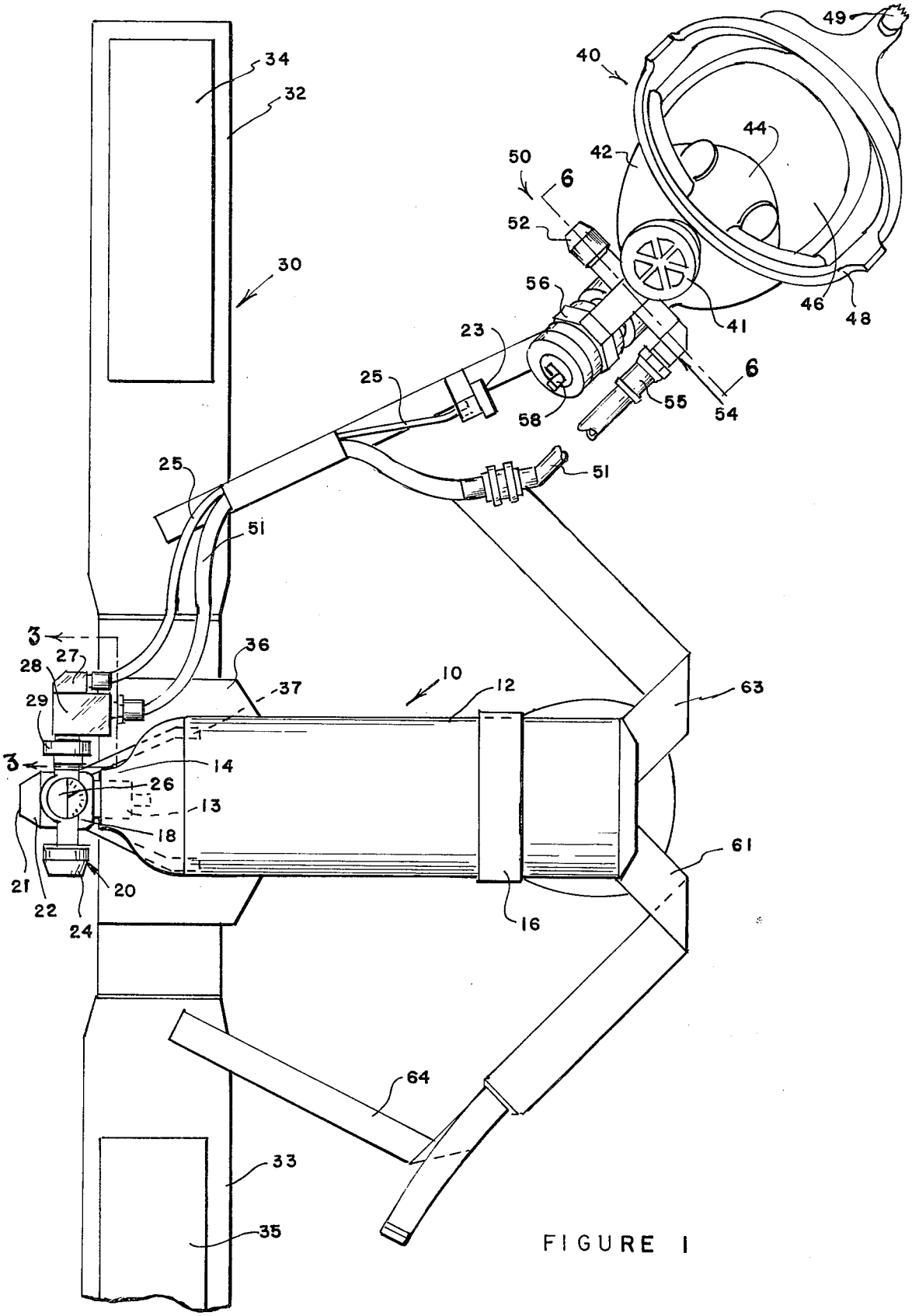
FIG. 1 illustrates the entire assembly of the air supply, body harness, valves and face mask.

Referring now to FIG. 1, the invention is shown as the assembly of an air supply means 10, a shut-off and pressure reduction valve assembly 20; a body harness 30; a face mask 40; and a face mask pilot regulator valve assembly 50.

The air supply means 10 includes a generally cylindrical pressure vessel 12 which can be of metallic construction or a combination of metallic and plastic construction. A particularly useful construction comprises an aluminum vessel which is laminated with continuous filament fiberglass reinforced with a resin such as an epoxy or polyester resin. The cylinder employed is typical of that used for 30 minute air supply systems and contains 45 cubic feet of air at 4500 psi. The cylinder has a reduced diameter neck 14 having an internally threaded aperture 13 with the standard fitting of the Compressed Gas Association (CGA) for air. The cylinder is retained in the assembly by a fabric band clamp 16 which encircles the cylinder at a position intermediate its length and by a circular yoke 18 which receives the valve assembly 20.

The valve assembly includes a shut-off valve 22 with a control knob 24 and an indicator 26 that provides a visual indication of the air pressure within the cylinder 12. The main valve 22 has a "lock on" feature. The control knob 24 is opened by turning in a clockwise direction and has detents which provide audible clicks on turning. When the knob 24 is turned past two clicks, the valve is wide open. The valve locks in the opened position and must be depressed simultaneously while rotating clockwise for closing.

The first stage pressure reduction valve 28 is coupled through the main valve with a modified CGA No. 346 fitting 29. The reducer regulates the cylinder pressure to about 100 psig for supply to the face mask pilot regulator 50. The first stage pressure reduction valve also includes an air bypass fitting 27 that supplies air pressure through flexible hose 25 to a remote visual pressure gauge 23 to provide a remote indication of the pressure of the air supply cylinder 12. The first stage pressure reduction valve 28 is connected through flexible hose 51 to the face mask regulator assembly 50 as described hereinafter.

The face mask 40 is a standard, mask commercially available from Sierra Engineering, Sierra Madre, Calif. This mask has an elastomer body 42 that receives the pilot regulator assembly 50. The mask includes a detachable, interior mouth and nose fitting 44. The mask of course, includes a transparent eye and face shield 46 mounted in a molded frame 48 of the body 42. The mask also includes flexible strap or rigid plastic flange which fits over the head of the user to secure the mask assembly 40 in place.

The harness assembly 30 supports the aforementioned elements. This body assembly includes a cumberbund 32 and 33 having mating Velcro fastener sections 34 and 35 for encircling the waist of the wearer and providing an instant and an infinite number of adjustment capabilities to the wearer. The harness 30 centrally carries a support plate 36 which supports a frame 37 carrying the aforementioned yoke 18.

Figure 2:
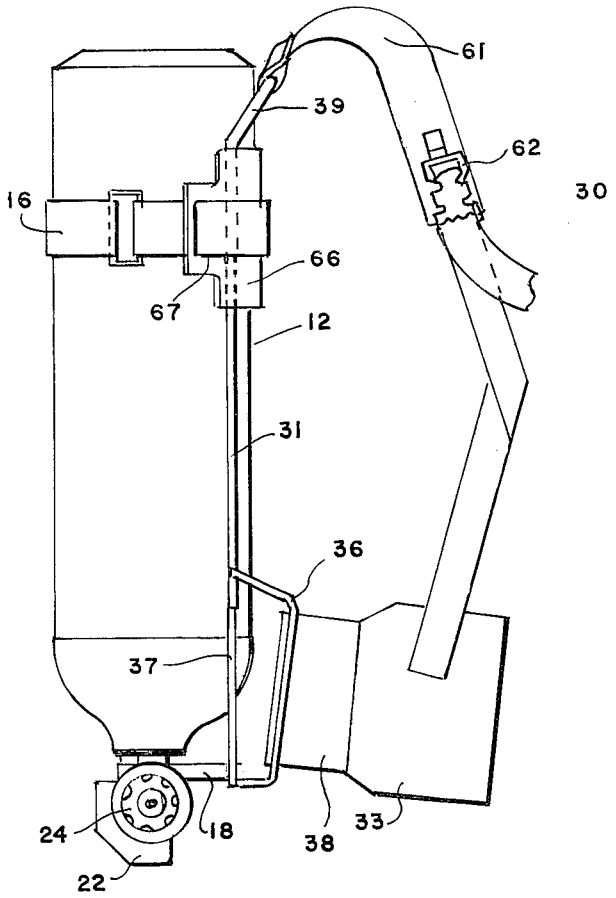
FIG. 2 is a side elevational view of the body harness and air supply cylinder.

Referring to FIG. 2, the harness assembly 30 can be seen in greater detail. As there illustrated, the plate 36 is attached to medial tabs 38 of the cumberbund segments 32 and 33. The frame structure includes longitudinal members 31 which extend along the length of the cylinder 12 with a distal, bent loop 39 that secures the ends of shoulder straps 61 and 63. The shoulder straps have an adjustment buckle 62 with cooperative chest bands 64 and 65 that extend to a sewn attachment to the cumberbund segments 33 and 32. The longitudinal frame members 31 also support an arcuate bracket 66 having slots such as 67 for receiving the fabric band clamp 16 which secures the air cylinder 12 in the assembly.

The frame and harness assembly 30 are designed so that the weight of the unit is carried at the hips, rather than on the shoulders of the user, resulting in a better balance of the load. The user may move over hazardous terrain more safely since the center of gravity for the breathing system is closer to the body's natural center of gravity than the more conventional backpack assemblies which put most of the weight on the shoulders of the user. This allows safer operation with less fatigue and permits the bottle to be changed quickly without tools and without requiring the wearer to remove the assembly.

The face mask pilot regulator assembly 50 shown in FIG. 1 includes a mask bypass valve having a control knob 52 to permit venting of the supply air into the mask body 42 from which it exits the mask through exhalation valve 41. The pilot regulator assembly 50 has an inlet fitting 54 for attachment to the flexible hose 51 with snap acting or quick connect elements 55. The regulator valve 56 comprises a pilot valve controlled regulator and includes an externally mounted switch 58 which permits switching the operation of the regulator valve structure 56 between pressure demand and demand modes of operation, thereby permitting donning of the face mask assembly 40 with the valve in a demand position, conserving the limited supply of air in air cylinder 12.

Figure 3:
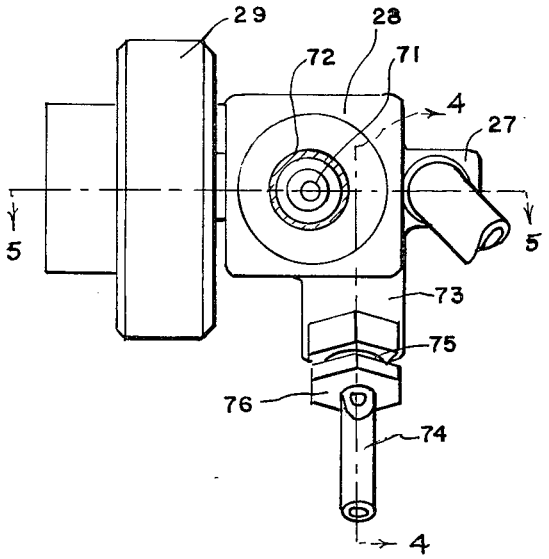
FIG. 3 is a sectional view along lines 3—3 of FIG. 1, showing the structure of the pressure regulator valve.

Referring now to FIG. 3, there is illustrated the first stage pressure reduction valve 28 and the bypass fitting 27. This assembly includes the previously mentioned modified CGA No. 346 fitting 29 described and illustrated in greater detail hereinafter with reference to FIG. 5. This fitting 29 is received in a threaded aperture of the valve body 28. The valve body 28 includes, not only the air outlet port 71 and fitting 72 for receiving the flexible hose fitting 51, but additionally, houses an audible signal generating means 73. The audible signal generating means comprises a tubular whistle 74 secured to the valve body 28 by plug member 75 which is received in an internally threaded aperture of body 28 and which has conventional, hexagonal wrench flats *76*.

Figure 4:
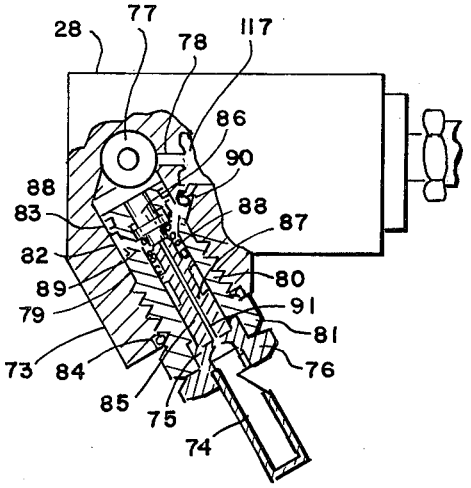
FIG. 4 is a view along lines 4—4 of FIG. 3.

Referring now to FIG. 4, the audible alarm means 73 will be described in greater detail. As there illustrated, body 28 has an inlet passageway 77 which extends transversely of body 28 and which is in communication with a small diameter orifice bore 78 leading to the bore 117 of the pressure reduction valve section, described in greater detail with reference to FIG. 5. Passage 77 also communicates with bore 79 that extends longitudinally with the audible alarm section 73. bore 79 has internal threads and receives the threaded shank 80 of plug 81. Plug 81 extends substantially the full length of bore 79 and has an annular groove 82 and a second annular groove 83 adjacent its inboard end. An O-ring is received in groove 83, sealing the assembly, together with O-ring 84 at the opposite end of shank 80 of plug 81. The plug 81 has a central through passageway 85, a poppet valve member 86 and valve seat member 87. These members have opposing, reduced diameter portions which provide an annular clearance in which is seated a resilient helical coil compression spring 88. Spring 88 is operative to resiliently bias the popit valve member 86 away from the valve seat member 87.

The valve body 28 is also provided with bore 90 which interconnects bore 117 and annular groove 82, thereby applying the inlet air pressure to the latter. A plurality of bores 89 are provided interconnecting the annular groove 82 with the through bore 85 of plug 81.

The operation of the audible alarm device is fairly apparent from the preceding description. The poppet valve assembly including the poppet valve member 86 and cooperating seat member 87 are retained in the sealed position, as shown by the application of the cylinder pressure with inlet passageway 77 to the poppet valve member 86, overcoming the resilient bias of spring 88. When the inlet pressure falls below a predetermined value, such as 1100 psig, the spring 88 urges the poppet valve member 86 away from the valve seat member 87, opening the through bore 91 of the valve seat member to bore 85. This permits passage of air from bore 78, through communicating bore 90, annular chamber 82, and bores 89, to the audible alarm device, tubular whistle 74. A feature of this invention is that the whistle is actuated by the air from the reduced pressure bore 117, i.e., with air downstream of the first pressure reduction stage. This insures that the whistle is activated by a substantially constant, reduced pressure air supply and operates at a substantially constant output intensity independently of declining pressure in the air bottle 12.

Figure 5:
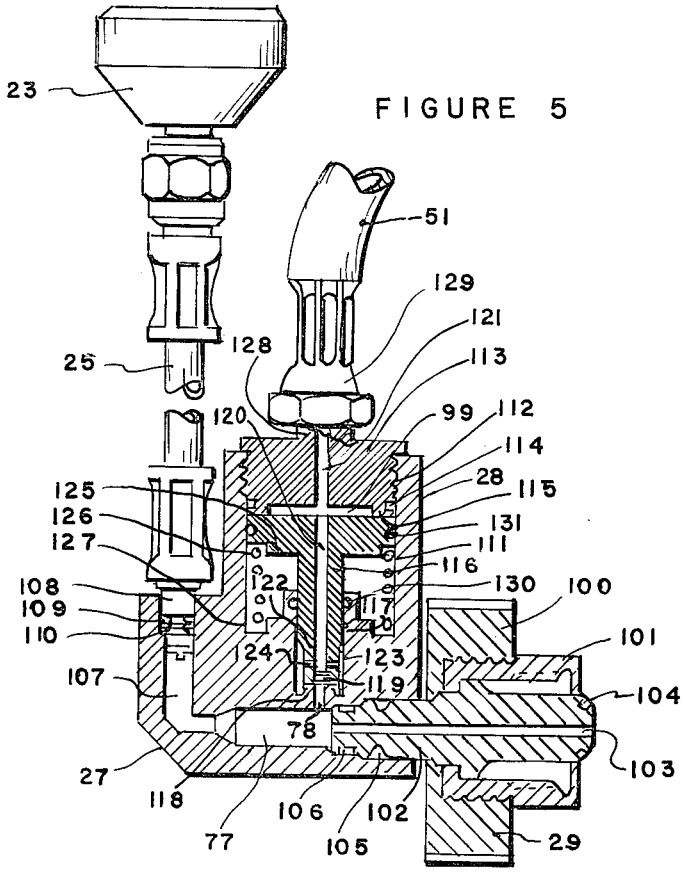
FIG. 5 is a sectional view along lines 5—5 of FIG. 3.

Referring now to FIG. 5, there is shown the pressure reduction valve body 28 in a sectional view along lines 5—5 of FIG. 3. The body 28 has an offset lateral portion 27 that provides a bypass connection to flexible tubing 25 leading to remote pressure gauge 23, previously described with regard to FIG. 1. The modified CGA No. 346 fitting 29 comprises a nut assembly of an outer annular nut 100 and a smaller diameter nut 101. This assembly is carried on cylindrical nipple 102 having a through bore 103 and an annular groove 104 at its outboard end for receiving an O-ring and effecting a seal to the shut-off valve 22, shown in FIG. 1. The cylindrical nipple 102 has two annular grooves, 105 and 106 adjacent its inboard end. Groove 105 receives a spirol pin to secure the assembly and groove 106 receives an O-ring sealing the nipple in body 28. The through passageway 103 discharges to the transverse bore 77 which communicates with an intersecting bore 107 in the lateral portion 27 of body 28. Bore 107 receives fitting 108 that is connected to tubing 25 and that is secured and sealed in the assembly by spirol pin 109 and O-ring 110, respectively.

The pressure reduction valve is contained within the main body 28 of the assembly. The body is provided with a large diameter bore 111 that is internally threaded at 112 to receive the threaded plug member 113 which has an annular groove 114 for seating of an O-ring seal. Plug member 113 has a central, recessed face to provide a chamber 99. A valve member 115 is slidably received within bore 111 and sealed therein by O-ring 131 and has a reduced diameter shank 116 that is received in the reduced diameter, coaxial bore 117 of body 28 and sealed therein by O-ring 130. This bore communicates with the orifice 78 opening into the inlet air passageway bore 77. A valve seat 118 surrounds this small diameter orifice bore 78 and the inboard end of shank 116 of moveable valve member 115 bears a soft seal member 119 that coacts with the valve 118. The valve member 115 has a central bore 120 which is substantially coextensive but which does not extend through the valve member 115. Plug 113 has a similar, axially aligned central bore 121. The inboard end of valve member 116 has a reduced diameter tip portion 122 to provide an annular zone 123 thereabout and a plurality of bores 124 are provided communicating between the annular space and the central bore 120. The undersurface of valve member 115 has an annular shoulder 125 to provide a retaining groove for spring 126 and an opposed annular groove 127 is provided on the inside face of bore 111 to capture the coil spring 126 therein.

Body 28 has a neck 128 bearing external threads to receive the threaded fitting 129 of hose 51 that extends to the face mask regulator assembly 50, shown in FIG. 1.

The operation of the pressure reduction valve is fairly apparent from the preceding description. The cylinder pressure is admitted to the inlet passage bore 77 and is applied, through orifice bore 78 to the annular zone 123 through the variable orifice spacing between the valve seat 118 and seal 119 of valve member 115. This pressure is applied through the communicating lateral bores 124 and central bore 120 to the upper surface of the piston portion of valve member 115, within chamber 99 in the inner face of plug member 113. The resilient coil spring 126 applies a constant force to the moveable valve member 115, opposing the force on the upper surface of this member that results from the inlet fluid pressure. The force of the resilient spring 126 is preselected to provide a predetermined pressure drop through the orifice gap formed by valve seat 118 and seal member 119. This pressure drop is sufficient to reduce the inlet pressure to about 100 psig for supply through tubing 51 to the face mask regulator assembly 50. As the inlet pressure declines with the decaying pressure in the air cylinder 12, valve member 115 is moved by spring 127 away from valve seat 118, thereby reducing the pressure drop through the valve member and maintaining the outlet pressure substantially constant at 100 psig.

Figure 6:
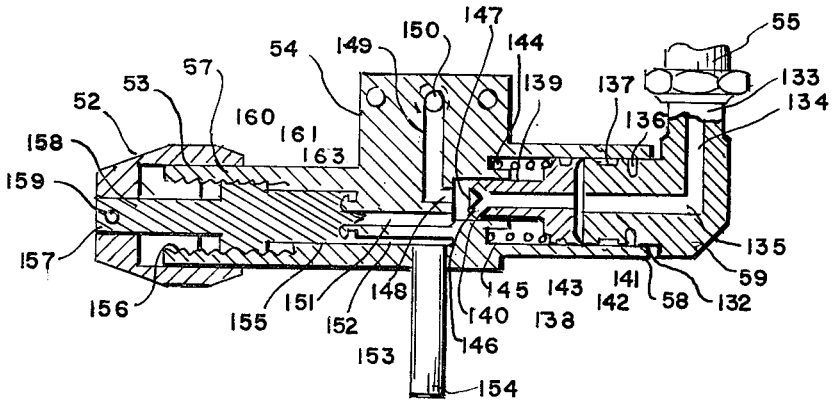
FIG. 6 is a sectional view along lines 6—6 of FIG. 1.

Referring now to FIG. 6, the mask bypass assembly will be described. FIG. 6 is a sectional view along lines 6—6 of FIG. 1, in a plane along the longitudinal axis of the bypass throttle valve 53. This throttle valve is mounted in a cylindrical boss 57 of body 54 of the mask regulator assembly. Body 54 has a second lateral boss 58 having a longitudinal bore 132 to receive elbow fitting 59. The latter has an externally threaded neck 133 to receive hose fitting 55 that is on the end of the flexible tubing 51 extending from the first stage pressure reducer body 28. Fitting 59 has a pair of intersecting bores 134 and 135 to provide fluid communication therethrough. The inboard end of fitting 59 has annular grooves 136 and 137 to receive, respectively, a spirol pin retainer and O-ring seal. The inlet bore 132 also receives a moveable valve member 138. The latter has a reduced diameter shank 139 which is received in bore 140 of the regulator body 54. The outer face of the piston portion of valve member 138 has a circular depression 141 that provides a working area for the air pressure. The periphery of the piston portion has an annular groove 142 to receive an O-ring seal and a second annular groove 143 on its inboard edge that serves as a retainer for the resilient compression coil spring 144. The opposite end of spring 144 is received in an annular groove 145 that is coaxial with bore 140.

The moveable valve member 138 has a through passageway 145 defined by a substantially coextensive central bore which intersects a pair of laterally inclined bores 146 at the tip end of the valve member 138. The valve member 138 also supports, at its inboard tip, a soft resilient seal member 147 which is opposed to the small diameter counterbore 148 in body 54 which communicates with a bore 149 that extends to the discharge bore 150 of body 54.

The valve member 138 comprises a safety cut-off valve which closes in the event that the pressure received through tubing 51 exceeds a predetermined value, e.g., 150 psig. This valve functions by the balance of the spring force of coil spring 144 against the working force of the air pressure developed on the piston surface of the recessed face 141 of valve member 138 such that when the inlet pressure exceeds about 150 psig, the resilient force of the spring is overcome and the valve member 138 closes, seating the seal 147 against the small diameter counterbore 148 in body 54.

Body 54 also has a small diameter bore 151 that is coaxial with the cylindrical boss 53 and another small diameter bore 152 parallel thereto. Bore 152 extends into communication with an intersecting bore 153 in body 54 that receives tubing 154 which is open at its outboard end to the atmosphere.

Cylindrical boss 53 has a central, coaxial bore 155 that bears internal threads at 156 for receiving valve member 157. The latter has an outboard shank portion 158 which is secured to knob 52 by a roll pin 159. The inboard end of the valve member 158 has a coaxial, needle-pointed tip 160 that is received within bore 151 and functions as a valve member therein. The base of bore 155 has an annular groove 161 to provide an annular seat about bore 151 and the inboard face of the valve member 158 has an annular groove 162 which receives a resilient seal for coacting with the valve seat and effecting sealing of the bypass passageway which extends through bore 151, past the valve seat 163, parallel bore 152 to the tubing 154.

Figure 7:
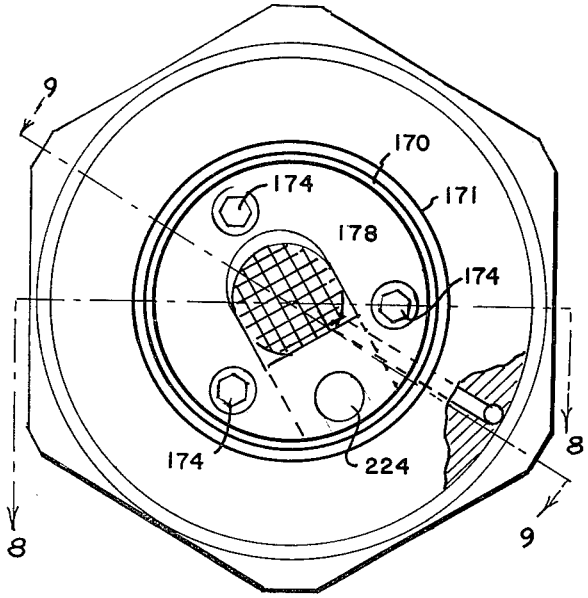
FIG. 7 is an end view of the face mask pilot regulator valve assembly.
Figure 8:
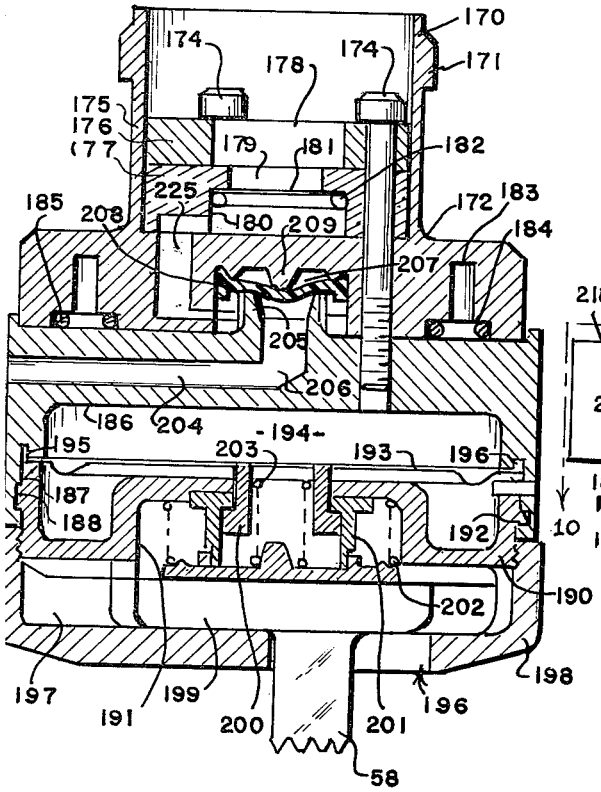
FIG. 8 is a sectional view along lines 8—8 of FIG. 7.

Referring now to FIGS. 7 and 8, there is illustrated the face mask pilot regulator unit. The regulator is shown in FIG. 7 in an end view as received in the face mask. The regulator body has a tubular discharge 170 with an annular shoulder 171 that is received in a mating aperture of the face mask. The regulator housing is formed of a pair of cylindrical body members 172 and 173 which are secured by a plurality of machine screws 174. The body member 172 is a generally flat plate with an upstanding sleeve neck 175 and interiorly receives plates 176 and 177. Plate 176 has a central aperture 178 which is aligned with aperture 179 of plate 177. The latter has a counterbore 180 which forms a shoulder for receiving filter screen 181 that is secured therein by a circular spring washer 182. The undersurface of plate 172 has a thin annular groove 183 that extends a substantial depth in plate 172 and a contiguous shallow and wider annular groove 184. O-rings 185 are placed in groove 184 to effect sealing of the annular groove 183.

Body member 173 has a circular recess 186 and an upper edge 187 of reduced thickness having an interior annular groove 188. This member receives a dish member 190 having a central concavity 191. The dish member 190 snaps into plate member 173 and has a peripheral bead 192 that engages the annular groove 188. A flexible diaphragm 193 is also secured in the assembly, across the interior chamber 194 defined by the body member 173 and dish member 190. Diaphragm 193 has a peripheral enlargement 195 which engages an annular recess 196 in the cylindrical wall of body member 173.

A button assembly 196 closes the cavity 197. The assembly includes a button support ring 198, switch member 199 having the switch projection 58 previously mentioned, second button 200, retaining ring 201, first coil spring 202 and second coil spring 203. The button 200 is slidably received within retaining ring 201 and is biased outwardly by the tension of coil spring 203. The entire assembly is received within the central well 191 of the dish member 190 which also receives spring 202 that biases the switch member 199 outwardly.

Switch member 199 is slidably received within cavity 197 and has a cam guide surface which advances or retracks the position of button 200 in the assembly as it is moved from side to side.

Figure 10:
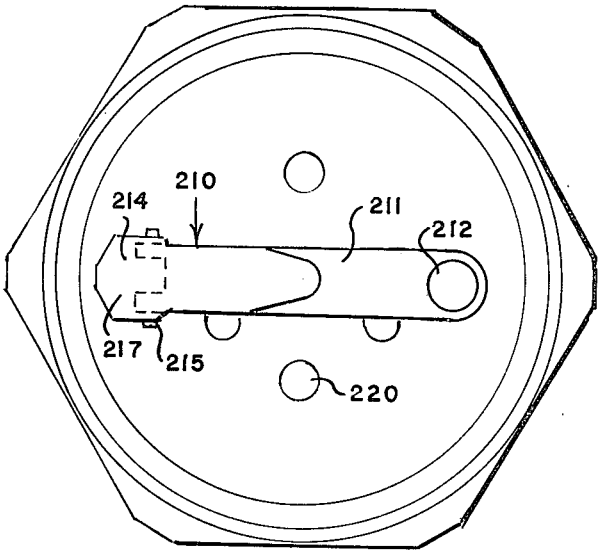
FIG. 10 is a view along lines 10—10 of FIG. 9.
Figure 9:
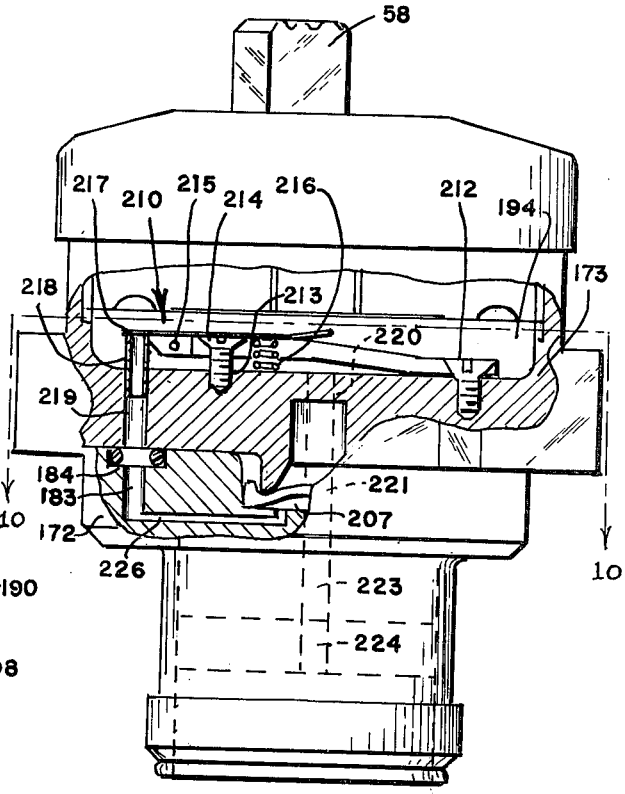
FIG. 9 is a sectional view along lines 9—9 of FIG. 7.

Referring now to FIGS. 9 and 10, the pilot valve assembly will be described. As shown in FIG. 10, a paddle assembly 210 is mounted within the cavity 194. The paddle assembly includes a paddle member 211, one end of which is fixed to the housing by screw 212. A second screw 213 fixedly adjusts the elevation of the opposite end of the paddle member within cavity 194. The pilot lever 214 is pivotally mounted on the free end of the paddle member 211 by pivot pin 215. A spring 216 biases the pilot lever so that pad 217 of lever 214 normally closes the open end of tubing 218 which is fixedly mounted in the bore 219 which communicates with the annular grooves 184 and 183 in body member 172. A radial bore 226 connects the annular groove 183 to the valve recess 207. A bore 220 in body member 173 communicates with bore 221 of body member 172 which in turn communicates with coaxial bores 223 and 224 of plates 176 and 177.

Referring to FIG. 8, the inlet passage to the valve assembly comprises bore 204 which communicates with a second, perpendicular bore 206 that terminates in a truncated valve seat 205. The body member 172 has a valve recess 207 having an outer, annular groove to receive the peripheral edge of a flexible valve member 208. The valve recess 207 has an axial projection 209 at the center of the valve recess.

In operation, the pressured air is supplied to the inlet bore 204 which communicates with the bore 206 on one side of valve 208. A bypass passageway, not shown, also communicates between bore 204 and annular groove 183. The annular groove 183, in turn, is in communication with the valve recess 207 through radial bore 226 of FIG. 9, thereby equalizing the pressure on the flexible valve 208. In this position, the valve 208 seats against the valve seat 205 because of the biasing force of the axial projection 209.

When the switch member 199 is in the position illustrated in FIG. 8, the valve is in the demand mode, inhalation by the wearer will effect a slight differential pressure across the diaphragm through the communicating bores 224, 223, 221 and 220, causing the diaphragm to flex against the pilot lever 214, opening the end of the pilot valve tube 218. The resulting evacuation of annular groove 183 unbalances the static pressure balance across the flexible valve member 208, causing the valve member to unseat from the valve seat 205, opening the air inlet passageway 204 and 206 to the bore 225 which communicates with the discharge passageway of the valve housing.

When the valve member 199 is moved to the opposite side of its position from that shown in FIG. 8, the switch member 199 moves inwardly and button 200 depresses the diaphragm sufficiently that the pilot lever 214 is unseated from the end of the pilot tube 218 so that the pilot passageway is retained in an open position. In this position, the annular groove 183 is vented through bores 200, 221, 223 and 224 and, accordingly, a slight positive differential pressure exists across valve member 208, unseating this valve member and permitting a continuous, controlled flow of air past the valve member and into bore 225 for delivery to the face mask.

Figure 11:
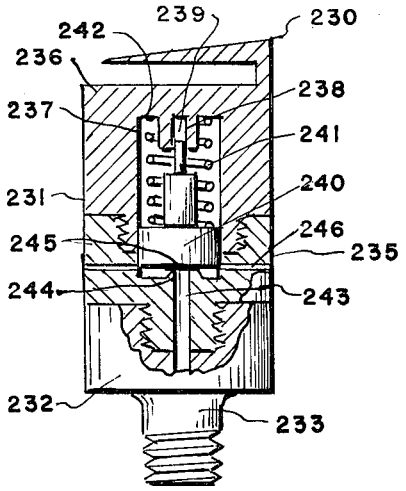
FIG. 11 illustrates an alternative audible alarm.

Referring now to FIG. 11, there is illustrated an alternative audible alarm device which can be substituted for the whistle device shown in FIGS. 3 and 4. As there illustrated, the audible device comprises a buzzer having a vibrating reed element 230 mounted on a body assembly 231. The body assembly comprises a first plug 232 having an externally threaded shank 233 for mounting in the internally threaded bore of body 73, shown in FIG. 4. A cylindrical casing 234 is threadably received in an internally threaded bore 235 on the opposite end of plug 232. The opposite end of cylindrical casing 234 receives a closure member 236 which has an integral vibrating reed 230. The closure member has a central recess 237 with a coaxial, cylindrical wall 238 defining a central well 239. A piston 240 is slidably received with the casing 234 and a resilient coil spring 241 is captured between the inward face of this piston and the annular recess 242 formed between bore 237 and annular wall 238. An air inlet passageway in the form of coaxial, small diameter bore 243 is formed on the forward portion of casing 234. This bore terminates in an annular valve seat 244 which is opposed to a soft seat valve member 245 carried on the face of piston 240. A plurality of radial bores 246 are provided through the wall of casing 234.

The operation of the buzzer device is apparent from the preceding construction. The application of air pressure to the inlet bore 243 will overcome the resilient bias of spring 241, unseating the valve member 245 and causing piston 240 to deflect inwardly in casing 234. The piston thereby uncovers the radial bores 246, venting the internal cavity of casing 234. This reduces the pressure in the casing 234 to permit the spring 241 to return the piston and cover the radial bores 246, whereupon the increasing air pressure reverses the movement of the piston. The result is that the piston 240 vibrates in the assembly and the frequency of the resulting vibration is imparted to the reed 230. Reed 230 is sized to provide a resonant frequency at the vibration frequency of piston 240 for the particular application. The result is an audible vibration or buzzer alarm.

The invention has been described with reference to the presently preferred and illustrated embodiment thereof. It is not intended that the invention be unduly limited by this description of the presently preferred embodiment. Instead, it is intended that the invention by defined by the means, and their obvious equivalents, set forth in the following claims.

What is claimed is:

1. In an emergency breathing device comprising a body harness supporting a pressured reservoir of breathable gas and a face mask with a gas supply regulator attached thereto and communicating with said reservoir by flexible hose means, and including reservoir shut off valve means having a valve body and valve member control knob carried on said reservoir and a first stage pressure reduction valve connected directly to said valve body of said shut off valve means and discharging to said flexible hose means, the improvement comprising a fluid pressure responsive audible generator and a fluid passage to apply fluid from downstream of said first stage pressure reduction valve to said audible generator, audible generator valve means in said fluid passage, resilient means biasing said audible generator valve means in a normally open position in said fluid passage and high pressure fluid passage means to apply the fluid pressure of said reservoir to close said audible generator valve means when said fluid in said reservoir is above a predetermined pressure; and wherein said gas supply regulator includes demand and pressure demand modes of operation and switch means to select one of said modes of operation; and wherein said gas supply regulator further includes a main valve recess having a central main valve seat with flexible valve member supported therein and biased against said main valve seat, means to apply inlet gas pressure to both sides of said flexible valve member, pilot valve means and gas pressure vent means communicating from said pilot valve means to said main valve recess on the side of said valve member opposite said main valve seat whereby opening and closing of said pilot valve means moves said flexible valve member away from and toward, respectively, said main valve seat.

2. The emergency breathing device of claim 1 wherein said pilot valve means includes a pilot valve paddle member pivotally mounted in said regulator body to open and close the pilot valve and said switch means coacts therewith to detain said paddle member in its pilot valve open position.

3. The emergency breathing device of claim 2 wherein said switch means is slidably mounted on the body of said regulator and carries a spring biased button that projects into said body and is moved toward and away from said paddle member as said switch is moved on said body.

4. The emergency breathing device of claim 3 wherein said regulator has a demand mode means including, in the body of said regulator an interior cavity, and said pilot valve and paddle member are mounted therein, and further including a flexible diaphragm extending across said cavity, axially juxtaposed to said paddle member, and a pressure sensing passageway extending from said cavity to the mask discharge of said regulator whereby inhalation pressure of a user is operative to flex said diaphragm and move said paddle member to an open position to open said main valve and admit said breathable gas to said face mask.

* * * * *